US010996598B2

(12) United States Patent
Nishikata et al.

(10) Patent No.: US 10,996,598 B2
(45) Date of Patent: May 4, 2021

(54) HEATER AND FIXING APPARATUS

(71) Applicant: CANON KABUSHIKI KAISHA, Tokyo (JP)

(72) Inventors: Kazushi Nishikata, Tokyo (JP); Ryota Ogura, Numazu (JP); Takafumi Suzuki, Suntou-gun (JP); Seiji Obata, Mishima (JP); Koichi Yamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/414,586

(22) Filed: May 16, 2019

(65) Prior Publication Data

US 2019/0369534 A1 Dec. 5, 2019

(30) Foreign Application Priority Data

May 30, 2018 (JP) ..... JP2018-103911

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039; G03G 15/2053
See application file for complete search history.

(56) References Cited

U.S. PATENT DOCUMENTS 6,090,305 A 7/2000 Balch et al.
2018/0335731 A1* 11/2018 Ogura ..... G03G 15/205

FOREIGN PATENT DOCUMENTS

| | | | |
|---|---|---|---|
| EP | 3261408 | A1 | 12/2017 |
| JP | H11345680 | A | 12/1999 |
| JP | 2003-347011 | A | 12/2003 |
| JP | 2004-054183 | A | 2/2004 |
| JP | 2007-242273 | A | 9/2007 |
| JP | 2017054071 | A | 3/2017 |

* cited by examiner

*Primary Examiner* — Clayton E. LaBalle
*Assistant Examiner* — Michael A Harrison
(74) *Attorney, Agent, or Firm* — Canon U.S.A., Inc. I.P. Division

(57) ABSTRACT

At least an electrode of a first electrode group and at least an electrode of a second electrode group are formed in a region nearer to one edge portion of a substrate than to a center of the substrate in a longer-side direction of the substrate, and the electrode that is nearest to the second electrode group in the longer-side direction among the first electrode group formed in the region nearer to the one edge portion and the second electrode group are provided with a space between the electrode and the second electrode group.

19 Claims, 14 Drawing Sheets

HEATER AND FIXING APPARATUS

BACKGROUND OF THE INVENTION

Field of the Invention

The present invention relates to a fixing apparatus mounted on an image forming apparatus using an electrophotographic recording method, such as a copying machine or printer, and a heater mounted on the fixing apparatus.

Description of the Related Art

Japanese Patent Application Laid-Open No. 2017-054071 discusses a fixing apparatus in which a heater including a plurality of independently-controllable heat generation blocks is provided in an inner space of a cylindrical fixing film. The heater is provided with a thermistor for each heat generation block. An electrode for feeding power to the heat generation block is provided to a surface of a heater substrate, and an electrode for the thermistor is provided to another surface of the heater substrate.

Basic insulation, or reinforced insulation in some cases, is needed between the electrode for the heat generation block and the electrode for the thermistor. In a case where the two electrodes are provided at the same position on the front and rear surfaces of the substrate, an insulation distance is required in both longer-side and shorter-side directions of the heater. However, if the width in the shorter-side direction of the heater is increased in order to preserve the insulation distance, the heat capacity of the heater increases, and the start-up time of the heater becomes longer. If an excess space portion is provided in the shorter-side direction of the heater, the heater becomes less resistant to thermal stress. Furthermore, wiring connected to each electrode via an electric connector is also required to preserve the insulation distance from the other electrode. Thus, in order to form the wiring while preserving the insulation distance, an excess space is needed. Especially in a division heater as discussed in Japanese Patent Application Laid-Open No. 2017-054071, the number of electrodes for heat generation members and electrodes for thermistors is significantly large. This makes it difficult to prevent congestion of the electric connectors and the wiring to the electrodes near an edge portion in the longer-side direction of the heater, and thus the apparatus size often increases.

SUMMARY OF THE INVENTION

The present invention is directed to a heater capable of ensuring insulation between an electrode for a heat generation block (heat generation member) and an electrode for a thermistor (temperature detection element), and a fixing apparatus including the heater.

According to an aspect of the present invention, a heater for use in a fixing apparatus configured to fix an unfixed toner image formed on a recording material to the recording material includes a substrate, a plurality of heat generation members which is formed on a first surface of the substrate and is controllable independently of each other, a first electrode group which is formed on the first surface and with which a plurality of first power feeding terminals configured to feed power to the plurality of heat generation members and provided to the fixing apparatus is in contact, a plurality of temperature detection elements formed on a second surface of the substrate which is on an opposite side to the first surface, and a second electrode group which is formed on the second surface and with which a plurality of second power feeding terminals configured to feed power to the plurality of temperature detection elements and provided to the fixing apparatus is in contact, wherein at least an electrode of the first electrode group and at least an electrode of the second electrode group are formed in a region nearer to one edge portion of the substrate than to a center of the substrate in a longer-side direction of the substrate, and wherein the electrode that is nearest to the second electrode group in the longer-side direction among the first electrode group formed in the region nearer to the one edge portion and the second electrode group are provided with a space between the electrode and the second electrode group.

Further features of the present invention will become apparent from the following description of exemplary embodiments with reference to the attached drawings.

DESCRIPTION OF THE EMBODIMENTS (Image Forming Apparatus)

Figure 1:
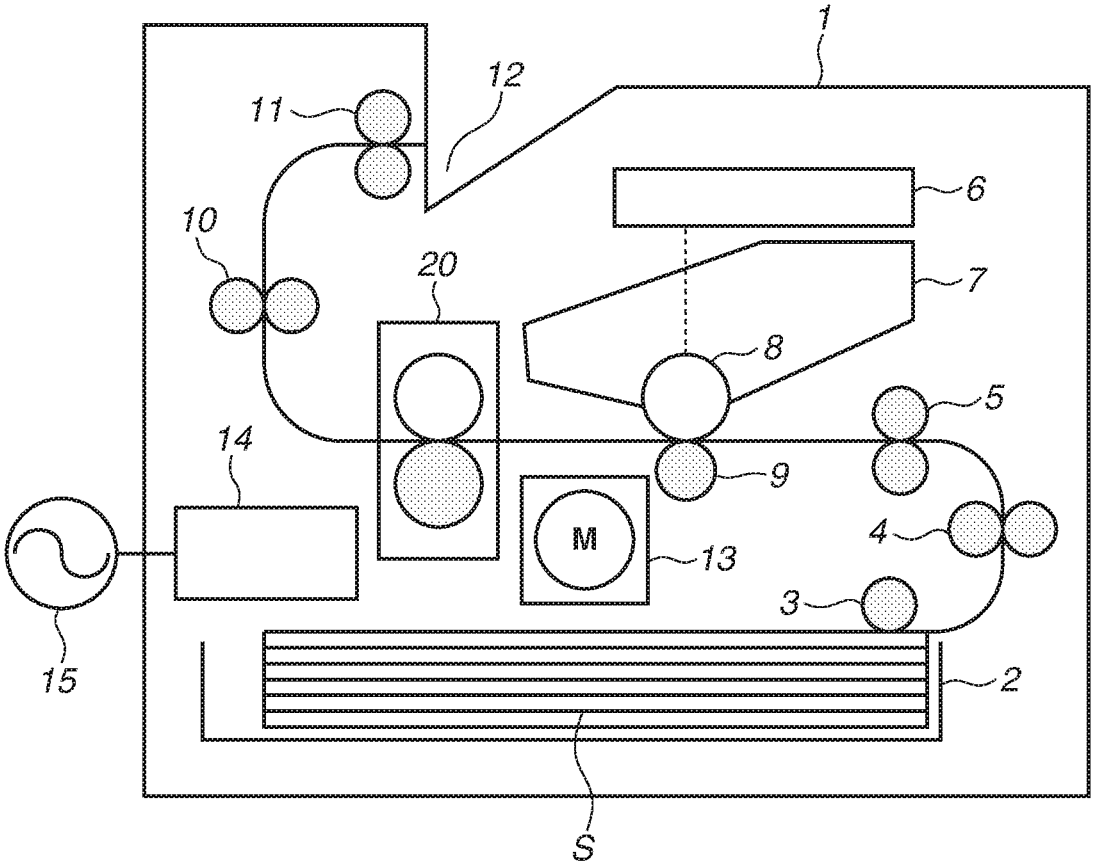
FIG. 1 is a cross-sectional view illustrating an image forming apparatus.

A first exemplary embodiment will be described below. FIG. 1 is a cross-sectional view illustrating an image forming apparatus (hereinafter, "laser beam printer") 1 using an electrophotographic technology. If a print signal is generated, a scanner unit 6 emits laser light modulated based on image information, and a photosensitive member 8 contained in an image forming processing unit 7 is scanned. An electrostatic latent image based on the laser light is formed on the photosensitive member 8, and if toner is supplied, a toner image based on the image information is formed on the photosensitive member 8. Meanwhile, a recording material S such as a normal sheet stacked on a sheet feeding cassette 2 is fed one by one by a pickup roller 3 and conveyed by a sheet conveyance roller 4 and a registration roller 5 toward an area between the photosensitive member 8 and a transfer roller 9. While the recording material S passes through the area between the photosensitive member 8 and the transfer roller 9, the toner image formed on the photosensitive member 8 is transferred onto the recording material S. Thereafter, the recording material S is heated by a fixing device 20, so that the toner image is heated and fixed to the recording material S. The recording material S carrying the fixed toner image is discharged onto a sheet discharge tray 12 provided to an upper portion of the laser printer 1 by a sheet conveyance roller 10 and a sheet discharge roller 11. A motor 13 drives the fixing device 20. A control circuit 14 is connected to a commercial power source 15 and supplies power to the fixing device 20 and the other loads.

(Fixing Device)

Figure 2:
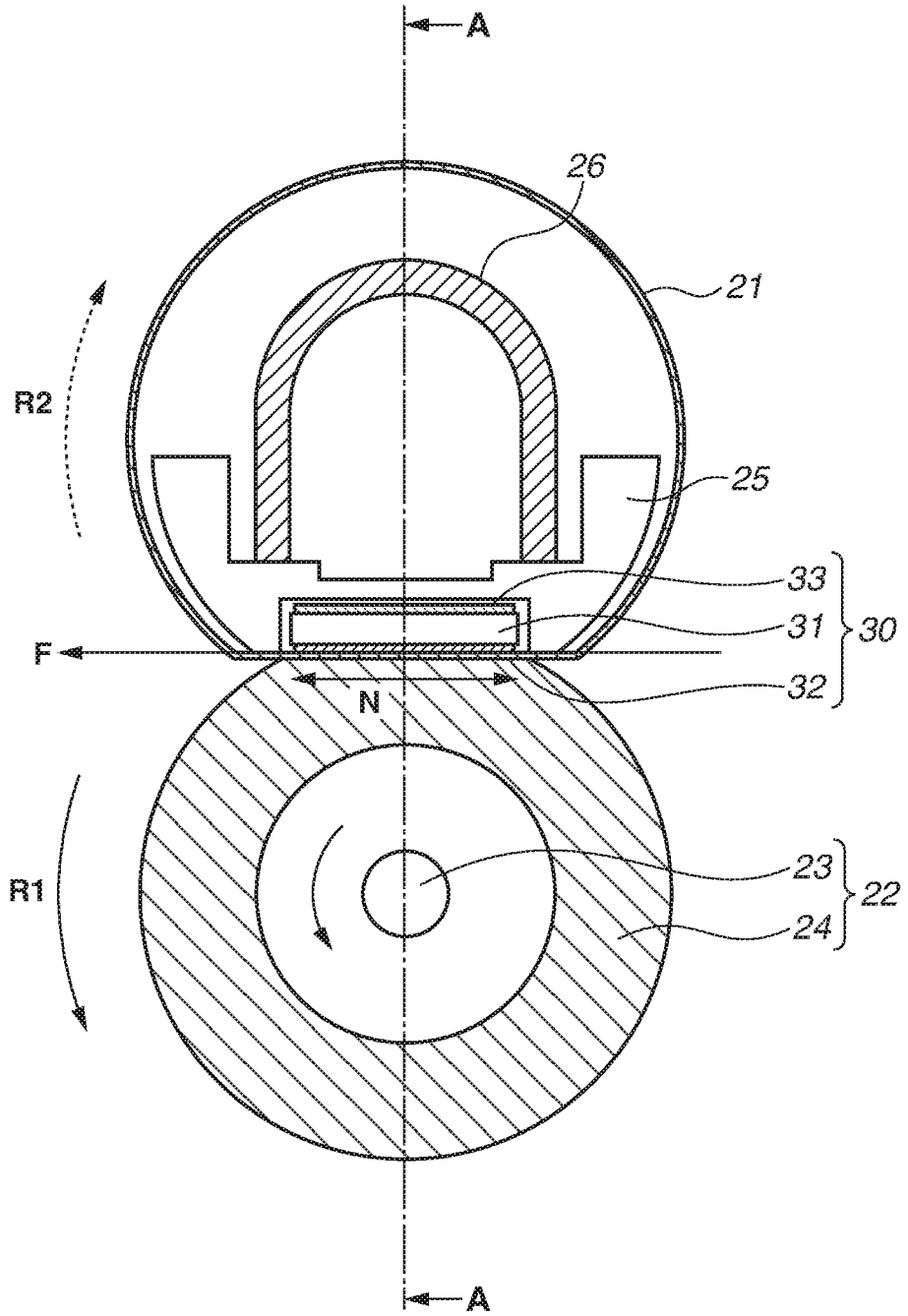
FIG. 2 is a cross-sectional view illustrating a fixing apparatus.

FIG. 2 is a cross-sectional view illustrating the fixing device 20. The fixing device 20 includes a cylindrical film (fixing film) 21, a heater 30, and a pressing roller (nip area forming member) 22. The heater 30 is in contact with an inner surface of the film 21. The pressing roller 22 forms a fixing nip area N together with the heater 30 via the film 21. The film 21 is in contact with an unfixed toner image formed on the recording material S. The pressing roller 22 includes a core metal 23 made of a material such as iron or aluminum and an elastic layer 24 made of a material such as heat-resistant rubber. The heater 30 is held by a heater holder 25 which is a holding member made of a heat-resistant resin. The heater holder 25 also has a guide function of guiding a rotation of the film 21. A metallic stay 26 is provided to apply the pressure of a spring (not illustrated) to the heater holder 25.

The stay 26 receives the pressure of the spring (not illustrated) and biases the heater 30 via the heater holder 25 toward the pressing roller 22. The elastic layer 24 of the pressing roller 22 receives the biasing force and is elastically deformed, and the fixing nip area N is formed. The film 21 is pinched at the fixing nip area N by the heater 30 and the pressing roller 22. If the pressing roller 22 is rotated in the direction of an arrow R1 by the motor 13 via a gear train (not illustrated), the film 21 pinched at the fixing nip area N is rotated in the direction of an arrow R2. An arrow F indicates a sheet conveyance direction of the recording material S. The recording material S carrying an unfixed toner image is conveyed into the fixing nip area N formed by the rotating pressing roller 22 and the rotated film 21 and undergoes heating and fixing processing (the unfixed toner image is fixed to the recording material S with heat of the heater 30) while being pinched and conveyed. A structure of the heater 30 will be described below.

Figure 3A:
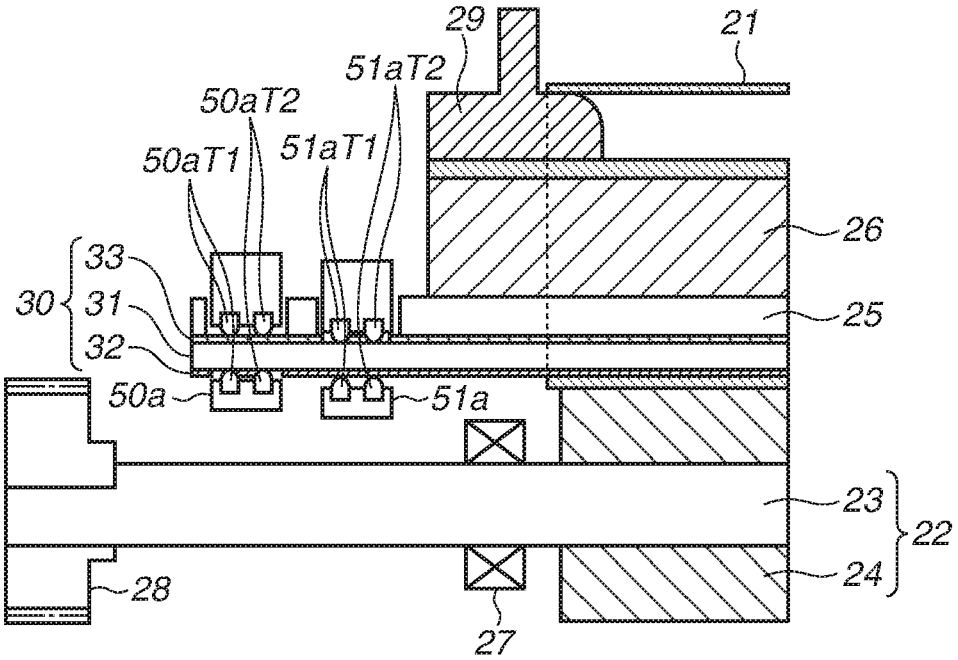
FIGS. 3A and 3B are cross-sectional views illustrating an edge portion of the fixing apparatus according to a first exemplary embodiment.
Figure 3B:
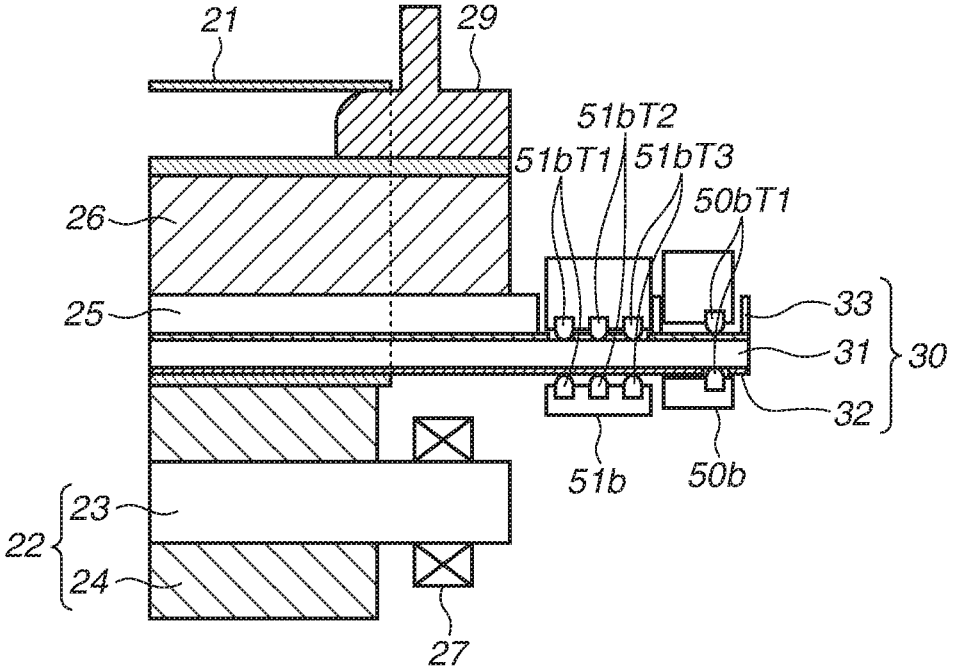

FIGS. 3A and 3B are cross-sectional views along a line A-A specified in FIG. 2 and illustrate a structure of an edge portion in a longer-side direction of the fixing device 20 according to the first exemplary embodiment. FIG. 3A illustrates a structure of a driving-side edge portion, and FIG. 3B illustrates a structure of a non-driving-side edge portion. A bearing 27 of the pressing roller 22 rotatably supports the pressing roller 22. An input gear 28 is attached to the pressing roller 22. A flange 29 is provided at a position facing both edge portions of the film 21 and guides a rotation locus of the film 21. Connectors 50*a*, 50*b*, 51*a*, and 51*b* are electric contact members connected to the heater 30. Details of the connectors 50*a*, 50*b*, 51*a*, and 51*b* will be described below.

(Heater)

Figure 4:
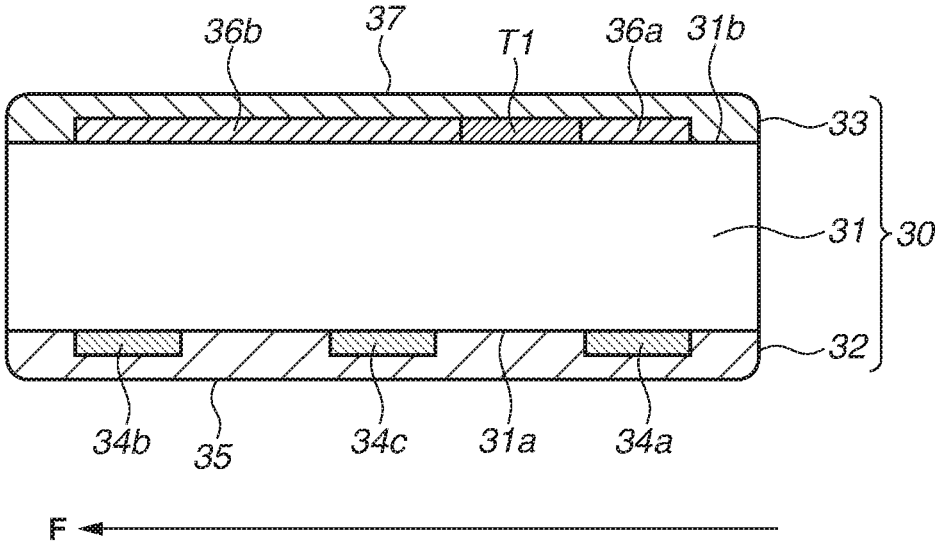
FIG. 4 is a cross-sectional view illustrating a heater.
Figure 5A:
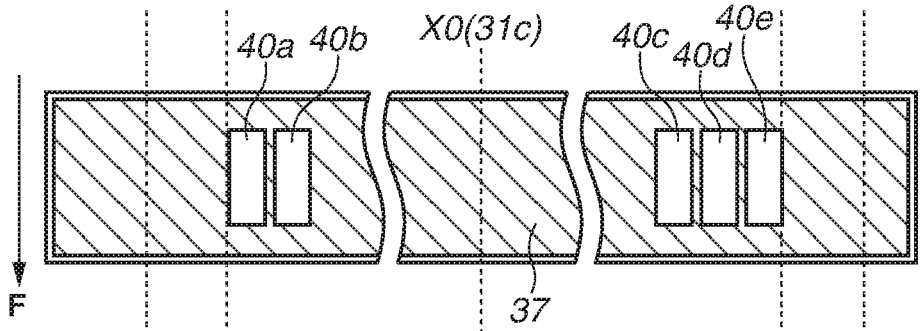
FIGS. 5A, 5B, 5C, and 5D illustrate the heater according to the first exemplary embodiment.
Figure 5B:
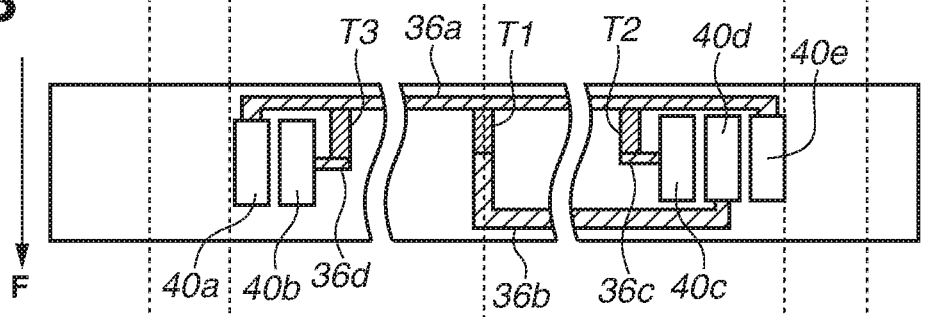
Figure 5C:
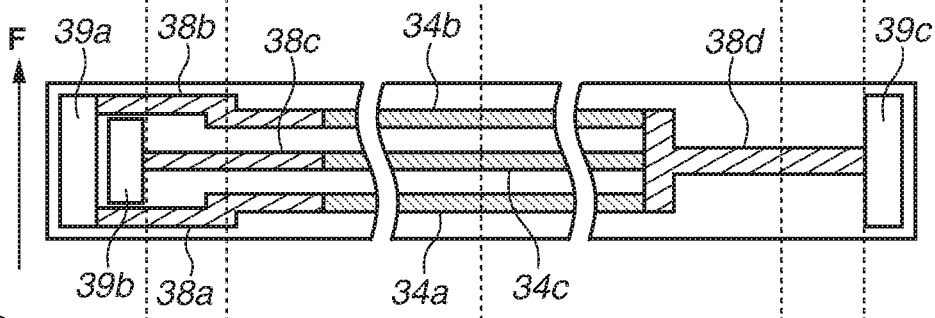
Figure 5D:
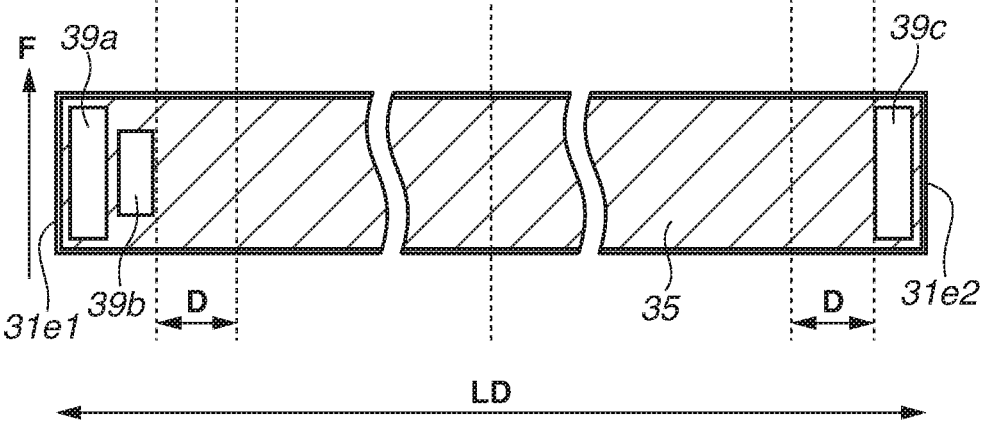

Next, a structure of the heater 30 according to the first exemplary embodiment will be described. FIG. 4 is a cross-sectional view illustrating a center of the heater 30 in the longer-side direction and corresponds to an enlarged view of the heater 30 illustrated in FIG. 2. FIGS. 5A, 5B, 5C, and 5D are plan views illustrating a structure of the heater 30 in a longer-side direction LD. FIGS. 5A and 5B illustrate the structure viewed from a rear surface layer 33. FIG. 5A is a top view with a protection glass 37, and FIG. 5B is a top view without the protection glass 37. FIGS. 5C and 5D illustrate the structure viewed from a sliding surface layer 32. FIG. 5D is a top view with a protection glass 35, and FIG. 5C is a top view without the protection glass 35. An arrow F specifies the sheet conveyance direction of the recording material S. Further, a reference X0 in FIGS. 5A to 5D is a recording material conveyance reference position and matches a center of the recording material S in a width direction of the recording material S. In a case of feeding the recording materials S of different sizes, the recording materials S are conveyed with the center of each recording material S in the width direction registered to the reference X0. In the case of the present exemplary embodiment, the reference X0 is a center 31*c* of a substrate 31 in the longer-side direction LD of the substrate 31.

The heater 30 in the present exemplary embodiment includes the substrate 31 and a plurality of heat generation members 34*a* to 34*c* which is formed on a first surface 31*a* of the substrate 31 and is controllable independently of each other. The heater 30 further includes a first electrode group including first electrodes 39*a* to 39*c* formed on the first surface 31*a*, and a plurality of power feeding terminals (first power feeding terminals) 50*a*T1, 50*a*T2, and 50*b*T1 for feeding power to the plurality of heat generation members 34*a* to 34*c* is in contact with the first electrodes 39*a* to 39*c*. The heater 30 further includes a plurality of temperature detection elements T1 to T3 formed on a second surface 31*b* of the substrate 31 which is on the opposite side to the first surface 31*a*. The heater 30 further includes a second electrode group including second electrodes 40*a* to 40*e* formed on the second surface 31*b*, and a plurality of power feeding terminals (second power feeding terminals) 51*a*T1, 51*a*T2, 51*b*T1, 51*b*T2, and 51*b*T3 for feeding power to the plurality of temperature detection elements T1 to T3 is in contact with the second electrodes 40*a* to 40*e*.

At least the first electrodes 39*a* and 39*b* of the first electrodes 39*a* to 39*c* and at least the second electrodes 40*a* and 40*b* of the second electrodes 40*a* to 40*e* are formed nearer to an edge portion (first edge portion) 31*e*1 than to the center 31*c* of the substrate 31 in the longer-side direction LD of the substrate 31. The electrode 39*b* which is nearest to the second electrodes 40*a* and 40*b* in the longer-side direction LD among the first electrodes 39*a* and 39*b* formed in the region nearer to the edge portion 31*e*1 and the second electrodes 40*a* and 40*b* are provided with a space of a distance D between the electrode 39*b* and the second electrodes 40*a* and 40*b*. The second electrodes 40*a* to 40*e* are provided nearer to the center 31*c* of the substrate 31 than the first electrodes 39*a* to 39*c* in the longer-side direction LD. Details thereof will be described below. An edge portion 31*e*2 (second edge portion) is another edge portion of the substrate 31.

The surface of the substrate 31 that is on the sliding surface layer 32 side is provided with the heat generation members 34*a* to 34*c* extending in the longer-side direction of the heater 30. The heat generation members 34*a* and 34*b* are respectively provided upstream and downstream in the sheet conveyance direction of the recording material S, and the heat generation member 34*c* is provided at a center. The insulative protection glass 35 is provided so as to cover an upper portion of the three heat generation members 34*a* to 34*c*. The film 21 is slid on a front surface of the protection glass 35. The rear surface layer 33 of the substrate 31 is provided with the printed thermistor (temperature detection element) T1 and conductors 36*a* and 36*b* for passing current to the thermistor T1. The thermistor T1 has a negative resistance temperature characteristic, has a characteristic that a resistance value changes depending on temperature, and has a function of detecting the temperature of the heater 30. The protection glass 37 is provided so as to cover the thermistor T1 and the conductors 36*a* and 36*b*.

As illustrated in FIG. 5C, the heat generation members 34*a* to 34*c* extend along the longer-side direction LD of the heater 30 on the sliding surface layer 32, and conductors 38*a* to 38*d* and the electrodes 39*a* to 39*c* for heat generation members are connected to edge portions of the three heat generation members 34*a* to 34*c*. The conductor 38*d* and the electrode 39*c* for heat generation members are a common conductive member and a common electrode connected to one edge of each of the three heat generation members 34*a* to 34*c*. The other edge of the heat generation member 34*a* is connected to the electrode 39*a* for heat generation members via the conductor 38*a*. Similarly, the other edge of the heat generation member 34*b* is connected to the electrode 39*a* for heat generation members via the conductor 38*b*. Similarly, the other edge of the heat generation member 34*c* is connected to the electrode 39*b* for heat generation members via the conductor 38*c*. Thus, the heater circuit is configured in such a manner that if power is fed between the electrodes 39*a* and 39*c* for heat generation members, the heat generation members 34*a* and 34*b* simultaneously generate heat, and if power is fed between the electrodes 39*b* and 39*c*, the heat generation member 34*c* generates heat. The protection glass 35 is provided at an upper portion of the sliding surface layer 32 so as to cover the components other than the electrodes 39*a* to 39*c* for heat generation members. Specifically, as illustrated in FIG. 5D, only the electrodes 39*a* to 39*c* for heat generation members are exposed. The power feeding terminals 50*a*T1, 50*a*T2, and 50*b*T1 of the electric contact members described below are in contact with the electrodes 39*a* to 39*c* for heat generation members, so that a power feeding circuit for feeding power from the commercial power source 15 to the heat generation members 34*a* to 34*c* is formed. In the heater 30 according to the present exemplary embodiment, two electrodes, the electrodes 39*a* and 39*b* for heat generation members, form an electrode group for heat generation members at the left edge portion in FIG. 5D, and one electrode, electrode 39*c* for heat generation member, is provided at the right edge portion in FIG. 5D.

Next, a structure of the rear surface layer 33 will be described with reference to FIG. 5B. The printed thermistors T1, T2, and T3 are formed on the second surface 31*b*. The conductors 36*a* to 36*d* and the electrodes 40*a* to 40*e* are connected to the thermistors T1, T2, and T3. The thermistors T1, T2, and T3 are connected to the control circuit 14 via the electric contact members and the conductive members described below. The control circuit 14 detects a temperature by measuring the resistance value of each of the thermistors T1, T2, and T3. The thermistor T1 is provided at a position that substantially corresponds to the sheet conveyance reference position X0. The control circuit 14 controls power to be fed to each heat generation member so as to maintain the detection temperature of the thermistor T1 at a target temperature suitable for fixing.

The thermistors T2 and T3 are formed near the edge portions of the heat generation members 34*a* to 34*c* in the longer-side direction LD. The thermistors T2 and T3 are provided to detect the temperature of a portion of the heater 30 by which no sheet passes in a case where small-size recording materials S consecutively passes. The conductor 36*a* is connected to one edge of each of thermistors T1, T2, and T3 and is also connected to the electrodes 40*a* and 40*e* provided at respective edges. The electrodes 40*a* and 40*e* are connected to a ground potential of the control circuit 14 via the electric contact members and the conductive members described below. Edges of the conductors 36*b* to 36*d* are respectively connected to thermistors T1 to T3, and the other edges of the conductors 36*b* to 36*d* are respectively connected to the electrodes 40*d*, 40*c*, and 40*b*. The protection glass 37 covers the component other than the electrodes 40*a* to 40*e*. Specifically, as illustrated in FIG. 5A, only the electrodes 40*a* to 40*e* are exposed at the rear surface layer 33, and the electric contact members described below are in contact with the electrodes 40*a* to 40*e*. In this way, the control circuit 14 detects the temperature of each of the thermistors T1, T2, and T3. In the present exemplary embodiment, the electrodes 40*a* and 40*b* for thermistors form part of the second electrode group, and the electrodes 40*c* to 40*e* for thermistors also form the second electrode group.

In the heater 30 according to the present exemplary embodiment, the electrode 39*b*, which is the nearest one of the electrodes 39*a* and 39*b* for heat generation members to the electrodes 40*a* and 40*b* for thermistors, and the electrode 40*a*, which is the nearest one of the electrodes 40*a* and 40*b* for thermistors to the electrodes 39*a* and 39*b* for heat generation members, are provided at the distance D from each other in the longer-side direction LD of the heater 30. The distance D is preserved to preserve a required insulation distance between the electrodes 39*a* to 39*c* for heat generation members and the electrodes 40*a* to 40*e* for thermistors. The distance D is preserved, so that the width of the substrate 31 of the heater 30 in the shorter-side direction does not have to be increased to preserve the insulation distance. In this way, the heater 30 is realized in which the insulation distance is preserved between the two electrodes while the heater 30 has excellent temperature-rise characteristics and is resistant to thermal stress applied to the substrate 31. The distance D is also preserved between the electrode 39*c* for heat generation members and the electrode 40*e* for thermistors which are provided between the center 31*c* and the edge portion 31*e*2.

(Structure of Electric Contact Member and Conductive Member)

Next, a structure of the electric contact members and the conductive members which are connected to the electrodes 39*a* to 39*c* for heat generation members and the electrodes 40*a* to 40*e* for thermistors and ensure energization to the control circuit 14 will be described with reference to FIGS. 3A, 3B, 6A, 6B, and 6C.

Figure 6A:
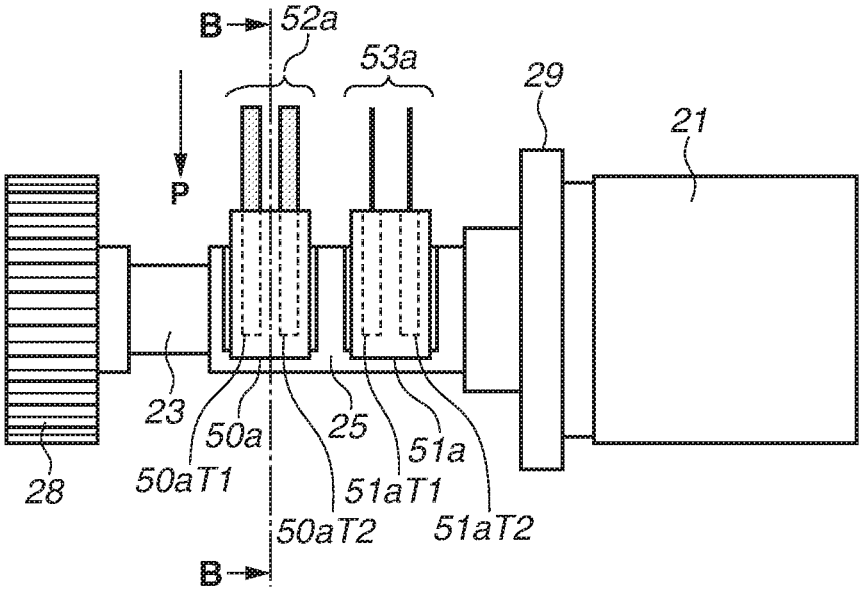
FIGS. 6A, 6B, and 6C are top views illustrating an edge portion of a fixing apparatus according to the first exemplary embodiment.
Figure 6B:
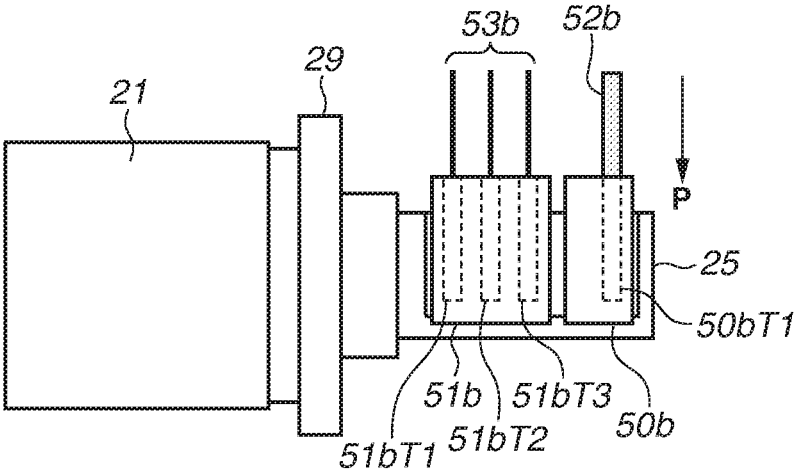
Figure 6C:
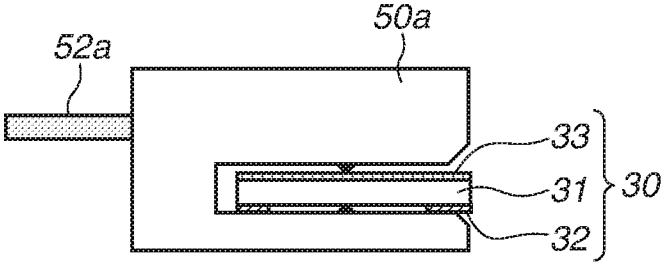

FIGS. 6A, 6B, and 6C are top views of FIGS. 3A and 3B. FIG. 6A illustrates a structure of the driving-side of the fixing device 20, and FIG. 6B illustrates a structure of the non-driving-side of the fixing device 20. The connectors 50*a* and 50*b* (electric contact members) for heat generation members are in contact with the electrodes 39*a* to 39*c* for heat generation members. The connector 50*a* is provided with the power feeding terminals 50*a*T1 and 50*a*T2. The power feeding terminal 50*a*T1 is in contact with the electrode 39*a* for heat generation members. The power feeding terminal 50*a*T2 is in contact with the electrode 39*b* for heat generation member. The connector 50*b* is provided with the power feeding terminal 50*b*T1. The power feeding terminal 50*b*T1 is in contact with the electrode 39*c* for heat generation members. The power feeding terminals 50*a*T1, 50*a*T2, and 50*b*T1 correspond to a plurality of first power feeding terminals provided to the fixing apparatus.

FIG. 6C is a cross-sectional view along a line B-B specified in FIG. 6A and illustrates a structure of the connector 50*a* for heat generation members. As illustrated in FIG. 6C, the connector 50*a* is a substantially U-shaped plug-in connector and is inserted in the direction of an arrow P into the electrodes 39*a* and 39*b* for heat generation members, so that the terminals 50*a*T1 and 50*a*T2 in the connector 50*a* are electrically connected to the electrodes 39*a* and 39*b* on the heater 30. The connector 50*b* has a similar structure and is connected to the electrode 39*c* for heat generation members. Conductive members (cables for heat generation member) 52*a* and 52*b* extend from the connectors 50*a* and 50*b* and are connected to the control circuit 14 through a path (not illustrated).

The connectors (electric contact member) 51*a* and 51*b* for thermistors are provided nearer to the center in the longer-side direction LD than the positions on the heater 30 to which the connectors 50*a* and 50*b* for heat generation members are connected. The connectors 51*a* and 51*b* are to be connected to the electrodes 40*a* to 40*e* for thermistors. Specifically, the second electrodes 40*a* to 40*e* are provided nearer to the center of the substrate 31 in the longer-side direction LD of the substrate 31 than the first electrodes 39*a* to 39*c*. The connectors 51*a* and 51*b* for thermistors are substantially U-shaped plug-in connectors similar to the connectors 50*a* and 50*b* for heat generation members and are to be connected to the electrodes 40*a* to 40*e* formed in the rear surface layer 33. The connector 51*a* is provided with the power feeding terminals 51*a*T1 and 51*a*T2. The power feeding terminal 51*a*T1 is in contact with the electrode 40*a*. The power feeding terminal 51*a*T2 is in contact with the electrode 40*b*. The connector 51*b* is provided with the power feeding terminals 51*b*T1, 51*b*T2, and 51*b*T3. The power feeding terminal 51*b*T1 is in contact with the electrode 40*c*. The power feeding terminal 51*b*T2 is in contact with the electrode 40*d*. The power feeding terminal 51*b*T3 is in contact with the electrode 40*e*. Conductive members (cables for thermistors) 53*a* and 53*b* extend from the connectors 51*a* and 51*b* for thermistors and are connected to the control circuit 14 through a path (not illustrated). The power feeding terminals 51*a*T1, 51*a*T2, 51*b*T1, 51*b*T2, and 51*b*T3 correspond to a plurality of second power feeding terminals provided to the fixing apparatus.

A feature of the present exemplary embodiment is that the connectors 51*a* and 51*b* for thermistors and the cables 53*a* and 53*b* for thermistors are provided along the shorter-side direction of the heater 30. Specifically, the second electrodes 40*a* to 40*e* are provided such that the plurality of second power feeding terminals 51*a*T1, 51*a*T2, 51*b*T1, 51*b*T2, and 51*b*T3 are connected to the second electrodes 40*a* to 40*e* from a direction which intersects with the longer-side direction LD of the substrate 31 and which is parallel to the second surface 31*b* of the substrate 31. Since the electrodes 39*a* to 39*c* for heat generation members are provided near the connectors 51*a* and 51*b* for thermistors and the cables 53*a* and 53*b* for thermistors, if the connectors 51*a* and 51*b* for thermistors and the cables 53*a* and 53*b* for thermistors are provided along the longer-side direction LD of the heater 30, it becomes difficult to preserve the insulation distance. Specifically, since the connectors 51*a* and 51*b* for thermistors and the cables 53*a* and 53*b* for thermistors are provided near and at the back of the electrodes 39*a* to 39*c* for heat generation members, so that it becomes difficult to preserve the insulation distance. In order to preserve the insulation distance, the electrodes 39*a* to 39*c* for heat generation members need to be provided at a great distance from the electrodes 40*a* to 40*e* for thermistors, but this leads to an increase in size of the heater 30 and the fixing device 20. In the structure according to the present exemplary embodiment, the insulation distance is preserved without situating the connectors 51*a* and 51*b* for thermistors and the cables 53*a* and 53*b* for thermistors at a great distance from the electrodes 39*a* to 39*c* for heat generation members, so that the structures of the edge portions of the heater 30 where the electrodes are congested can be a compact structure. While the cables 53*a* and 53*b* are wired upward (i.e., toward the upstream side of the sheet conveyance direction P of the recording material S) in FIGS. 6A and 6B in the present exemplary embodiment, the cables 53*a* and 53*b* can be wired downward (toward the downstream side of the sheet conveyance direction P).

Next, a structure of the heater 30 according to a second exemplary embodiment will be described. The components that have a similar structure or function to those in the first exemplary embodiment are given the same reference numerals, and description thereof is omitted. A cross-sectional structure of the heater 30 according to the second exemplary embodiment is similar to that in the first exemplary embodiment and is as illustrated in FIG. 4. Specifically, the sliding surface layer 32 on the substrate 31 is provided with the heat generation members 34*a* to 34*c*, and the rear surface layer 33 on the opposite side via the substrate 31 is provided with the thermistor T1 and the conductors 36*a* and 36*b*.

Figure 7A:
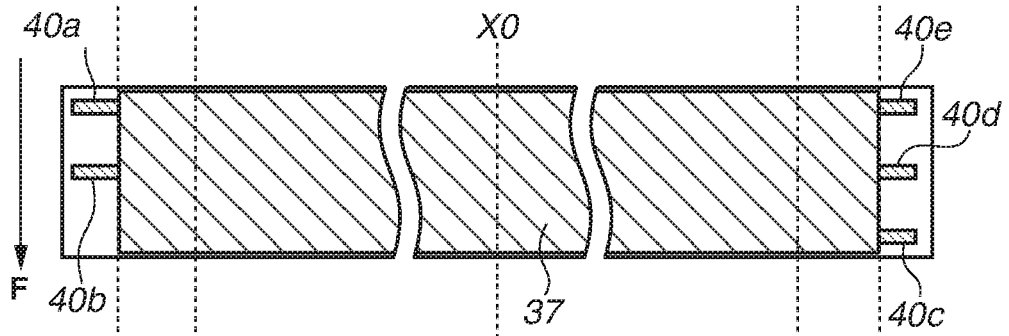
FIGS. 7A, 7B, 7C, and 7D illustrate the heater according to a second exemplary embodiment.
Figure 7B:
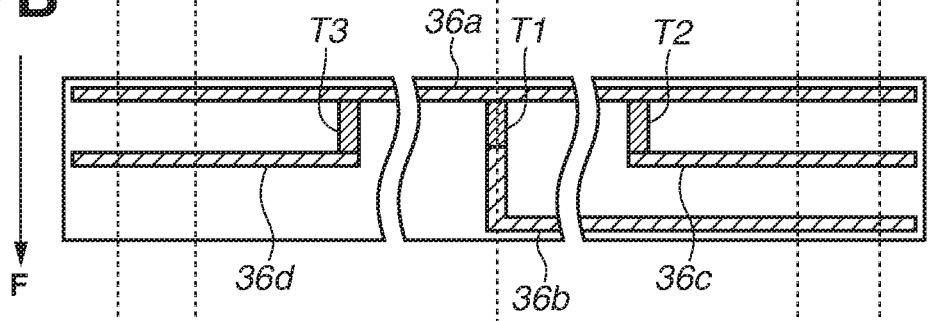
Figure 7C:
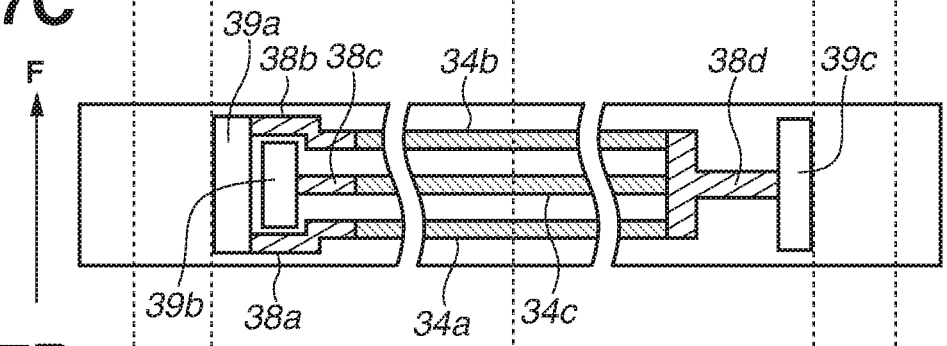
Figure 7D:
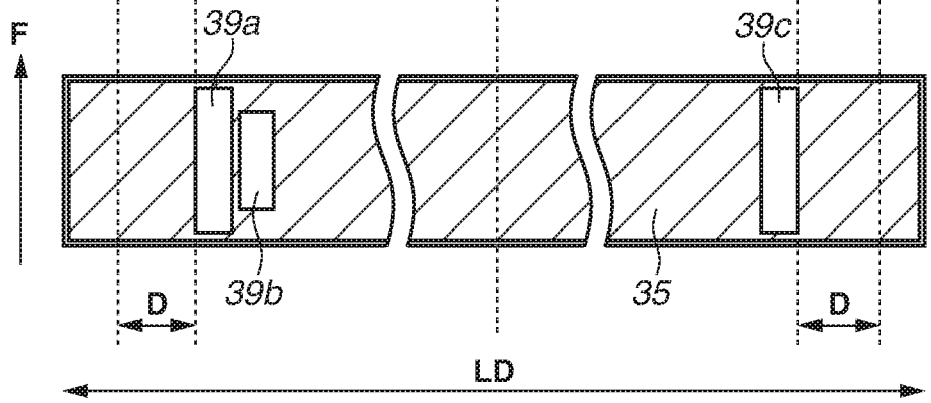

FIGS. 7A, 7B, 7C, and 7D are plan views illustrating a structure of the heater 30 according to the second exemplary embodiment. FIGS. 7A, 7B, 7C, and 7D are plan views illustrating a structure of the heater 30 in the longer-side direction. FIGS. 7A and 7B illustrate the structure viewed from the rear surface layer 33. FIG. 7A is a top view with the protection glass 37, and FIG. 7B is a top view without the protection glass 37. FIGS. 7C and 7D illustrate the structure viewed from the sliding surface layer 32. FIG. 7D is a top view with the protection glass 35. FIG. 7C is a top view without the protection glass 35.

The second exemplary embodiment is different from the first exemplary embodiment in the positions of the electrodes 39*a* to 39*c* for heat generation members and the electrodes 40*a* to 40*e* for thermistors in the longer-side direction in the heater 30. As illustrated in FIG. 7B, the rear surface layer 33 is provided with the conductor 36*a* which is connected to every one of thermistors T1 to T3 and extends to the respective edges of the heater 30 in the longer-side direction LD. Further, the conductors 36*b* to 36*d* are provided, and edges of the conductors 36*b* to 36*d* are respectively connected to thermistors T1 to T3 whereas the other edges of the conductors 36*b* to 36*d* extend to the edge portions of the heater 30. As illustrated in FIG. 7A, the protection glass 37 covers a portion of the conductors 36*a* to 36*d* in such a manner that the edge portions of the conductors 36*a* to 36*d* are exposed. In FIG. 7A, the exposed portions of the conductors 36*a* to 36*d* are the electrodes 40*a* to 40*e* for thermistors. The electrodes 40*a* and 40*b* for thermistors on the left hand side of FIG. 7A form the second electrode group, and the electrodes 40*c* to 40*e* for thermistors on the right hand side of FIG. 7A also form the second electrode group. The electrodes 39*a* to 39*c* for heat generation members are provided nearer to the center of the heater 30 in the longer-side direction LD than the electrodes 40*a* to

40*e* for thermistors. The electrodes 39*a* and 39*b* for heat generation members on the left hand side of FIGS. 7C and 7D form the first electrode group, and one electrode 39*c* for heat generation members is formed on the right hand side of FIGS. 7C and 7D. As in the first exemplary embodiment, the distance D is preserved between the electrode 39*a* for heat generation members and the electrodes 40*a* and 40*b* for thermistors and also between the electrode 39*c* for heat generation members and the electrodes 40*c* to 40*e* for thermistors, in the longer-side direction LD of the heater 30. As in the first exemplary embodiment, the distance D is a distance whereby the insulation distance is preserved between two electrodes.

In the heater 30 according to the present exemplary embodiment, the electrodes 39*a* to 39*c* for heat generation members are provided nearer to the center in the longer-side direction LD of the heater 30 than the electrodes 40*a* to 40*e* for thermistors. This structure makes it possible to reduce the distances between the electrodes 39*a* to 39*c* for heat generation members and the heat generation members 34*a* to 34*c*, so that an effect of voltage drop is minimized and higher heat generation efficiency of the heat generation members 34*a* to 34*c* than the first exemplary embodiment is realized.

Figure 8A:
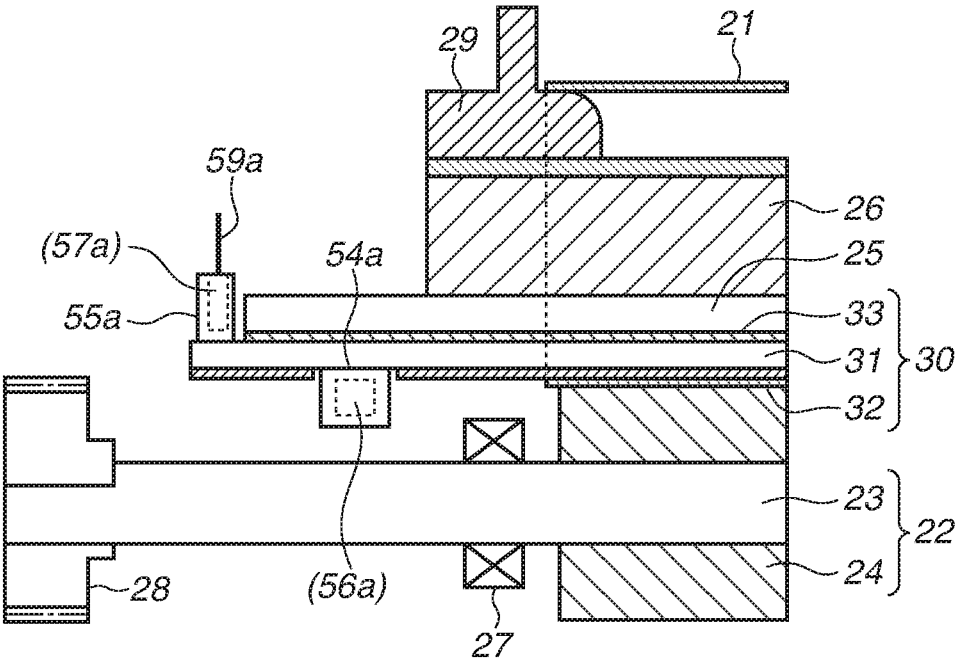
FIGS. 8A and 8B are cross-sectional views illustrating an edge portion of the fixing apparatus according to the second exemplary embodiment.
Figure 8B:
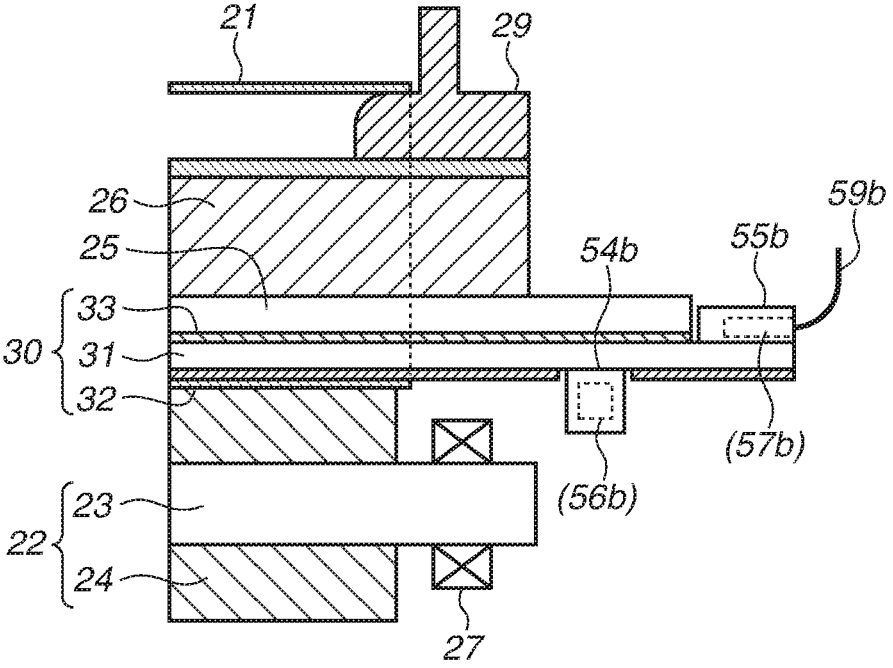
Figure 9A:
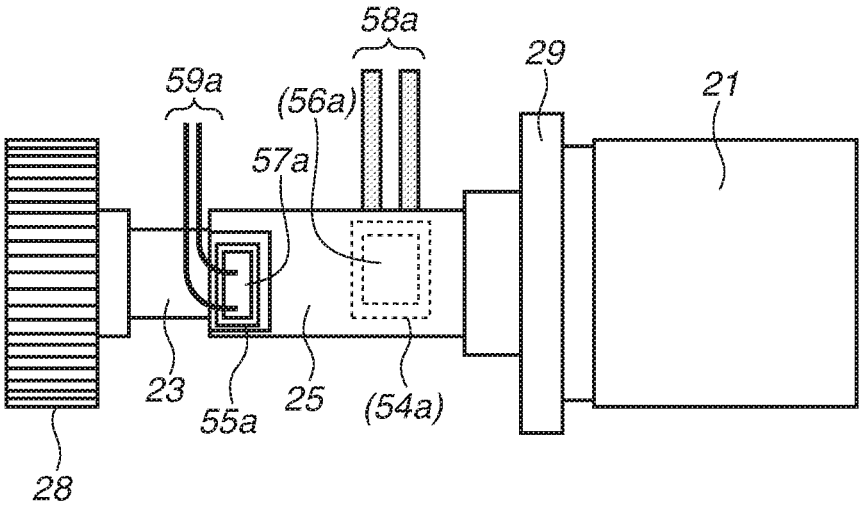
FIGS. 9A and 9B are top views illustrating the edge portion of the fixing apparatus according to the second exemplary embodiment.
Figure 9B:
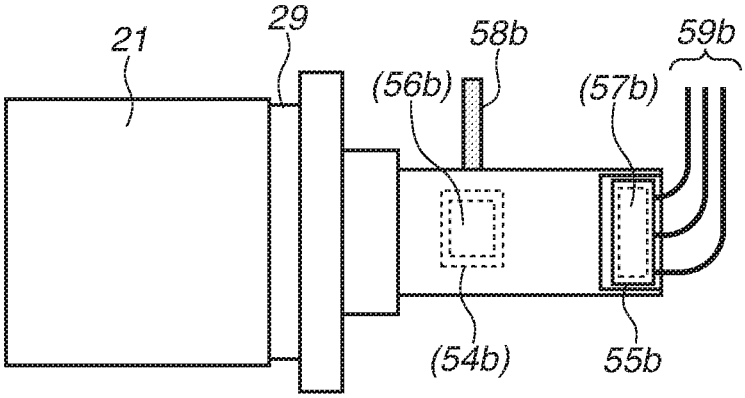

FIGS. 8A, 8B, 9A, and 9B illustrate a structure of the electric contact members and the conductive members according to the second exemplary embodiment. FIGS. 8A and 8B are cross-sectional views illustrating a structure of the edge portions of the fixing device 20 viewed from the direction of the line A-A specified in FIG. 2. FIG. 8A illustrates a structure of the driving-side edge portion, and FIG. 8B illustrates a structure of the non-driving-side edge portion. Further, FIGS. 9A and 9B are top views of FIGS. 8A and 8B. FIG. 9A illustrates the structure of the driving-side edge portion, and FIG. 9B illustrates the structure of the non-driving-side edge portion.

In the first exemplary embodiment, the U-shaped plug-in connectors are described as the electric contact members and the cables as the conductive members. In the second exemplary embodiment, connectors including combinations of male connectors to be attached to the heater 30 and cables having edges provided with female connectors are used. Male connectors 54*a* and 54*b* for heat generation members are electric contact members and attached to the heater 30. Male connectors 55*a* and 55*b* for thermistors are attached to the heater 30. Female connectors (first power feeding terminal) 56*a* and 56*b* are provided to the edges of the conductive members for heat generation members, and the conductive members include cables 58*a* and 58*b* joined to the female connectors 56*a* and 56*b* by crimping or welding. The conductive members for heat generation members are connected to the male connectors 54*a* and 54*b* for heat generation members. Similarly, female connectors (second power feeding terminal) 57*a* and 57*b* are provided to the edges of the conductive members for thermistors, and the conductive members include cables 59*a* and 59*b* joined to the female connectors 57*a* and 57*b* by crimping or welding. The conductive members for thermistors are connected to the male connectors 55*a* and 55*b* for thermistors. As described above, the first electrodes 39*a* to 39*c* are provided such that the plurality of first power feeding terminals 56*a* and 56*b* is connected to the first electrodes 39*a* to 39*c* from a direction which intersects with the longer-side direction LD of the substrate 31 and which is parallel to the first surface 31*a* of the substrate 31. The second electrodes 40*a* to 40*e* are provided such that the plurality of second power feeding terminals 57*a* and 57*b* is connected to the second electrodes 40*a* to 40*e* from a direction which intersects with the longer-side direction LD of the substrate 31.

In the second exemplary embodiment, the electric contact members for heat generation members (the connectors 54*a* and 54*b* for heat generation members) and the conductive members (the cables 58*a* and 58*b* for heat generation members) are also provided along the shorter-side direction of the heater 30. Specifically, as in the first exemplary embodiment, the electric contact members and the conductive members are provided inside in the longer-side direction LD so as to not pass through the back of the electrodes provided outside in the longer-side direction LD. In this way, the insulation distance is preserved between the electric contact members and the conductive members and the other electrodes.

Figure 10:
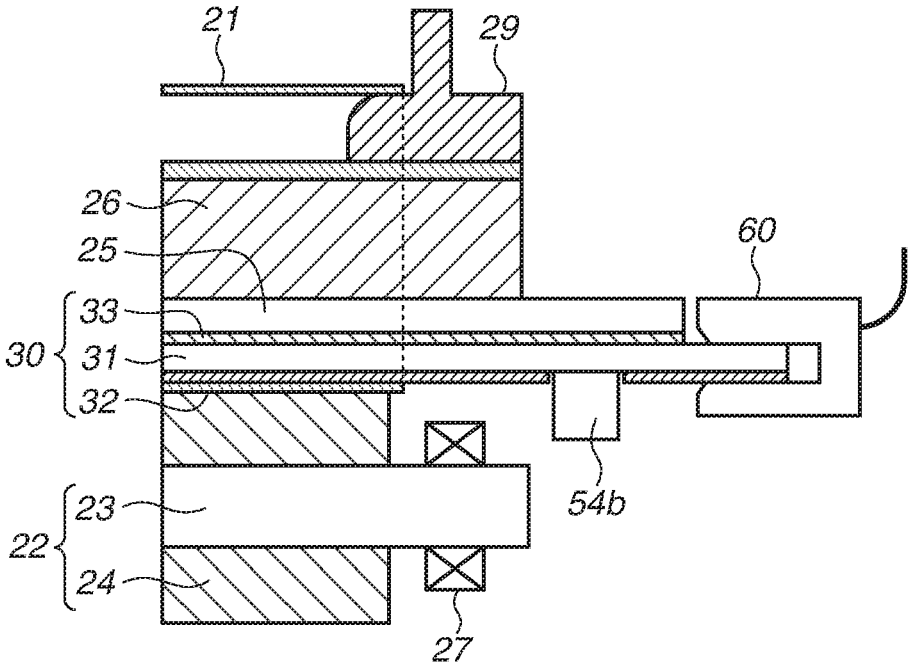
FIG. 10 illustrates another structure according to the second exemplary embodiment.

In the second exemplary embodiment, U-shaped plug-in connectors can be used as the electric contact members as in the first exemplary embodiment. FIG. 10 illustrates a structure in which a U-shaped plug-in connector 60 is provided as the electric contact member to the electrodes 40*a* to 40*e* for thermistors according to the second exemplary embodiment. The electric contact members can be configured to be insertable and removable in the longer-side direction LD as long as the electric contact members are provided outside in the longer-side direction LD as illustrated in FIG. 10. Specifically, the second electrodes 40*a* to 40*e* are provided such that the plurality of second power feeding terminals 60 is connected to the second electrodes 40*a* to 40*e* from a direction which is parallel to the longer-side direction LD of the substrate 31. While FIGS. 5A, 5B, 5C, and 5D illustrate the structure in which the electrodes 40*a* to 40*e* for thermistors according to the first exemplary embodiment are aligned in the longer-side direction, the electrodes 40*a* to 40*e* for thermistors can be aligned in the shorter-side direction of the heater 30 as long as the electrodes 40*a* to 40*e* are provided outside the heater 30 as in the second exemplary embodiment as illustrated in FIGS. 7A, 7B, 7C, and 7D. This structure has an advantage that the size of the heater 30 in the longer-side direction can be reduced compared to the first exemplary embodiment.

A heater according to a third exemplary embodiment is a heater in which a heat generation region is divided in the longer-side direction LD. The components that have a similar structure or function to those in the first and second exemplary embodiments are given the same reference numerals, and description thereof is omitted.

Figure 11:
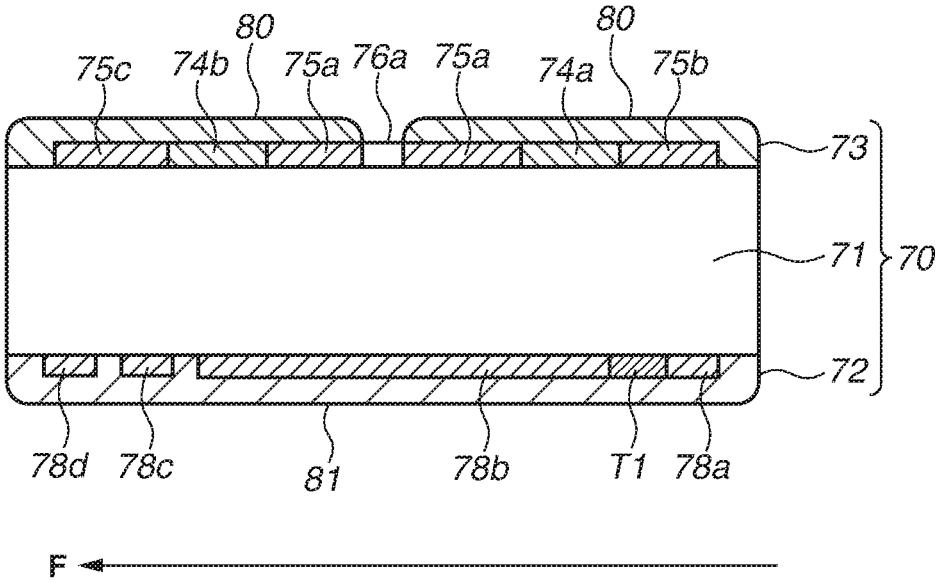
FIG. 11 is a cross-sectional view illustrating the heater according to a third exemplary embodiment.

FIG. 11 is a cross-sectional view illustrating a heater 70. FIGS. 12A, 12B, 12C, and 12D are plan views illustrating a structure of the heater 70. FIG. 11 is a cross-sectional view along the sheet conveyance reference position X0 specified in FIGS. 12A, 12B, 12C, and 12D.

As illustrated in FIG. 11, the heater 70 has a layered structure including a sliding surface layer 72, a substrate 71, and a rear surface layer 73. The structure is different from those in the first and second exemplary embodiments in that the thermistor T1 and conductive members 78*a* to 78*d* for thermistors are provided to the sliding surface layer 72, and heat generation members 74*a* and 74*b* and conductive members 75*a* to 75*c* for heat generation members and an electrode 76*a* are provided to the rear surface layer 73. The rear surface layer 73 includes the heat generation member 74*a* on the upstream side and the heat generation member 74*b* on the downstream side in the sheet conveyance direction F of the recording material S. The conductive members 75*b* and 75*a* are provided so as to sandwich the heat generation member 74*a*. Similarly, the conductive members 75*a* and 75*c* are provided so as to sandwich the heat generation member 74*b*. If power is fed between the conductive members 75*b* and 75*a*, the heat generation member 74*a* generates heat. Similarly, if power is fed between the conductive members 75*a* and 75*c*, the heat generation member 74*b* generates heat. The electrode 76*a* is one of electrodes for heat generation members. The cross-sectional structure is configured in such a manner that a protection glass 80 covers the heat generation members 74*a* and 74*b* and the conductive members 75*a* to 75*c* and the electrode 76*a* for heat generation members is exposed.

Figure 12A:
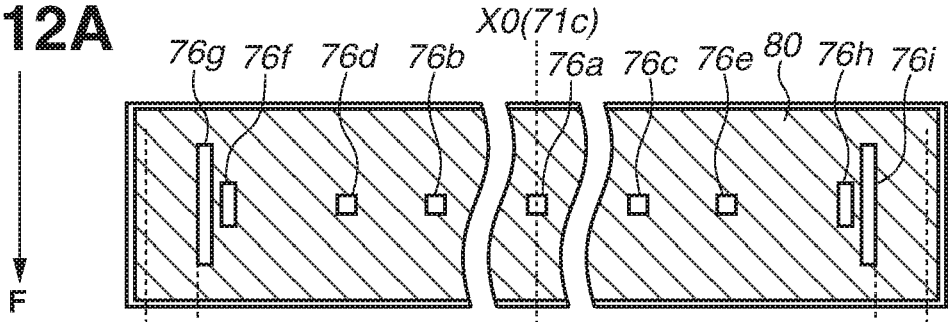
FIGS. 12A, 12B, 12C, and 12D illustrate the heater according to the third exemplary embodiment.
Figure 12B:
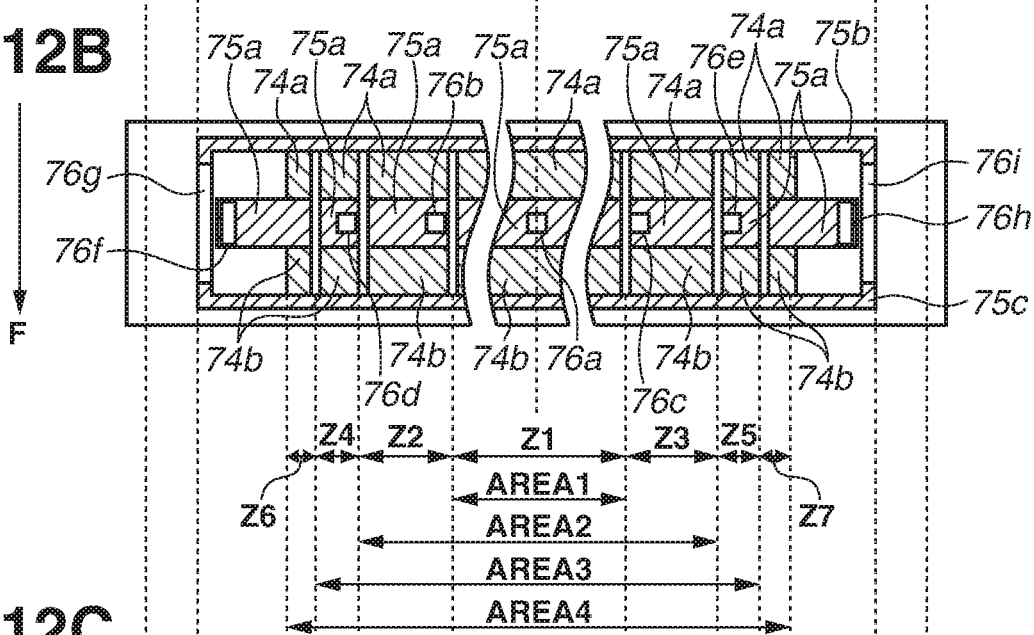
Figure 12C:
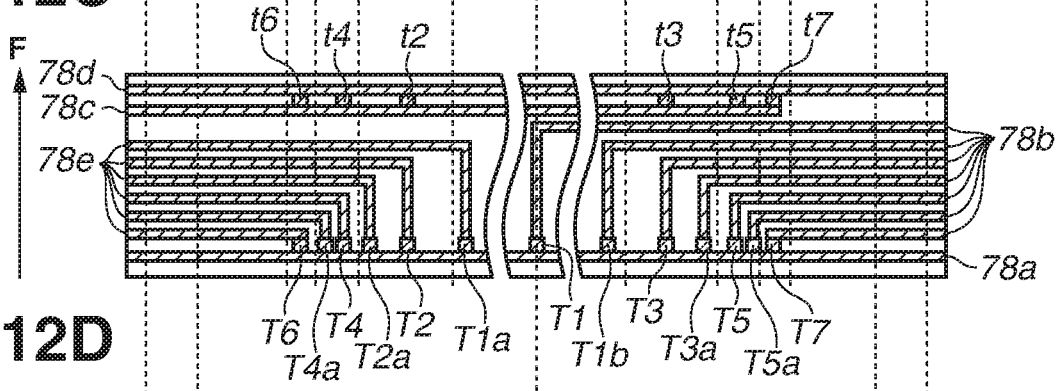
Figure 12D:
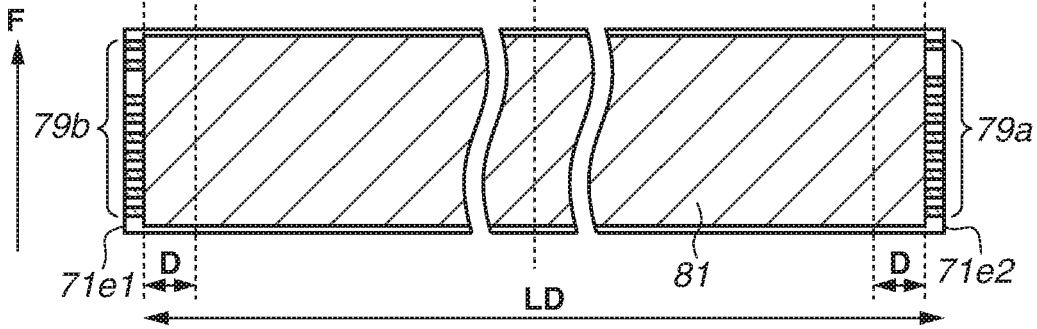

A planar structure of each layer of the heater 70 will be described with reference to FIGS. 12A, 12B, 12C, and 12D. FIGS. 12A and 12B illustrate the structure viewed from the rear surface layer 73. FIG. 12A is a top view with the protection glass 80, and FIG. 12B is a top view without the protection glass 80. FIGS. 12C and 12D illustrate the structure viewed from the sliding surface layer 72. FIG. 12D is a top view with a protection glass 81, and FIG. 12C is a top view without the protection glass 81.

As illustrated in FIG. 12B, the rear surface layer 73 of the heater 70 is provided with seven heat generation blocks each including the conductive members 75*b*, 75*a*, and 75*c*, the heat generation member 74*a* provided on the upstream side, the heat generation member 74*b* provided on the downstream side, and the electrode 76 for heat generation members, in the longer-side direction. The seven heat generation blocks are denoted by Z1 to Z7 in FIG. 12B. Further, as illustrated in FIG. 12A, the protection glass 80 is formed on a portion excluding the electrodes 76*a* to 76*i* for heat generation members, and an electric contact (not illustrated) is connectable from the rear surface side of the heater 70. The control circuit 14 independently controls power supply to each heat generation block so that the amounts of heat generation of the respective heat generation blocks can be independently controlled. By division into the seven heat generation blocks as described above, at least four heat generation distributions AREA to AREA4 specified in FIGS. 12B and 12C are formed. In the present exemplary embodiment, AREA1 is classified as a heat generation distribution for A5-size sheets, AREA2 as a heat generation distribution for B5-size sheets, AREA3 as a heat generation distribution for A4-size sheets, and AREA4 as a heat generation distribution for LETTER sheets. The seven heat generation blocks are independently controlled so that the heat generation block that is to feed power can be selected depending on the size of the recording material S, and thus application of excess heat to the region through which no sheet passes is prevented. The length of the heat generation region and the number of heat generation blocks are not limited to those specified in the present exemplary embodiment. Further, the heat generation members 74*a* and 74*b* in each heat generation block are not limited to the continuous pattern as described in the present exemplary embodiment and can be a pattern that includes rectangles with spaces therebetween. In the present exemplary embodiment, the electrodes 76*a*, 76*b*, 76*d*, 76*g*, and 76*f* for heat generation members which are provided in a region from a substrate center 71*c* to a substrate edge portion 71*e*1 form the first electrode group. The electrodes 76*c*, 76*e*, 76*h*, and 76*i* for heat generation members which are provided in a region from the substrate center 71*c* to another substrate edge portion 71*e*2 form the first electrode group.

The sliding surface layer 72 of the heater 70 is provided with thermistors T1 to T7, T1*a*, T1*b*, T2*a* to T5*a*, and t2 to t7 for detecting the temperature of each heat generation block of the heater 70. The thermistors T1 to T7 are mainly used to control the temperature of each heat generation block (control to maintain a constant temperature) and are each provided at a substantially central portion of each heat generation block. Hereinafter, the thermistors T1 to T7 will be referred to as "central thermistors".

The thermistors T1*a*, T1*b*, and T2*a* to T5*a* are thermistors for detecting the temperature of an edge portion of each heat generation block. Hereinafter, the thermistors T1*a*, T1*b*, and T2*a* to T5*a* will be referred to as "edge portion thermistors". The edge portion thermistors are provided in the respective heat generation blocks excluding the heat generation blocks (Z6, Z7), which are respectively provided at the edges and have a small heat generation region, and each edge portion thermistor is provided nearer to an edge portion of the heat generation block than to the center of the heat generation block. No edge portion thermistor is provided in the heat generation blocks Z6 and Z7 because the heat generation regions of the heat generation blocks Z6 and Z7 are small and no edge portion thermistor needs to be provided.

The thermistors t2 to t7 are sub-thermistors provided to detect a temperature even in a case where the central thermistors or the edge portion thermistors become out of order. The sub-thermistors t2 to t7 are provide at substantially the same positions as the central thermistors T2 to T7 in the longer-side direction LD.

One edges of the central thermistors T1 to T7 and the edge portion thermistors T1*a*, T1*b*, and T2*a* to T5*a* are connected to the common conductive member 78*a*, and the other edges are connected to the conductive member 78*b* and 78*e*. One edges of the sub-thermistors t2 to t7 are connected to the common conductive member 78*c*, and the other edges are connected to the common conductive member 78*d*. The conductive members 78*a* to 78*d* extend to the edges of the heater 70 in the longer-side direction.

As illustrated in FIG. 12D, the protection glass 81 covers the various thermistors and the conductive members 78*a* to 78*d* in such a manner that the edge portions of the conductive members 78*a* to 78*d* are exposed. The exposed portions of the conductive members 78*a* to 78*d* become electrodes 79*a* and 79*b* for thermistors and form the second electrode group.

With the above-described heater circuit structure, the temperature of each heat generation block is independently controllable while the temperatures are detected in detail. This makes it possible to provide a fixing device capable of performing optimum control for the size of a recording material S to be conveyed. While the structure including the sub-thermistors is described in the present exemplary embodiment, the structure is not limited to the above-described structure. The sub-thermistors are included to enable more advanced and elaborate control.

The first electrodes 76*a* to 76*i* are aligned in the longer-side direction LD of the substrate 31, and the second electrodes 79*a* and 79*b* are aligned in the shorter-side direction of the substrate 31. The distance D is provided also in the present exemplary embodiment between the outermost electrodes 76*i* and 76*g*, among the electrodes 76*a* to 76*i* for heat generation members, and the electrodes 79*a* and 79*b* for thermistors, respectively. The distance D is a distance whereby an insulation distance is preserved between two electrodes, as in the first and second exemplary embodiments. Further, the first electrodes 76*a* to 76*i* for heat generation members are provided nearer to the center in the longer-side direction LD than the electrodes 79*a* and 79*b* for thermistors, as in the second exemplary embodiment.

Figure 13A:
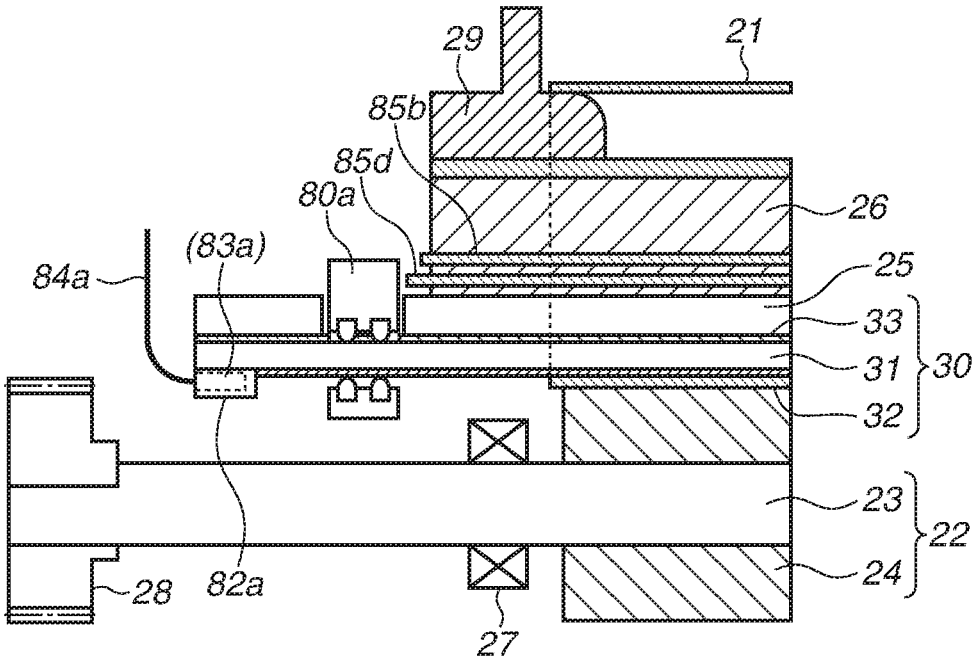
FIGS. 13A and 13B are cross-sectional views illustrating the edge portion of the fixing apparatus according to the third exemplary embodiment.
Figure 13B:
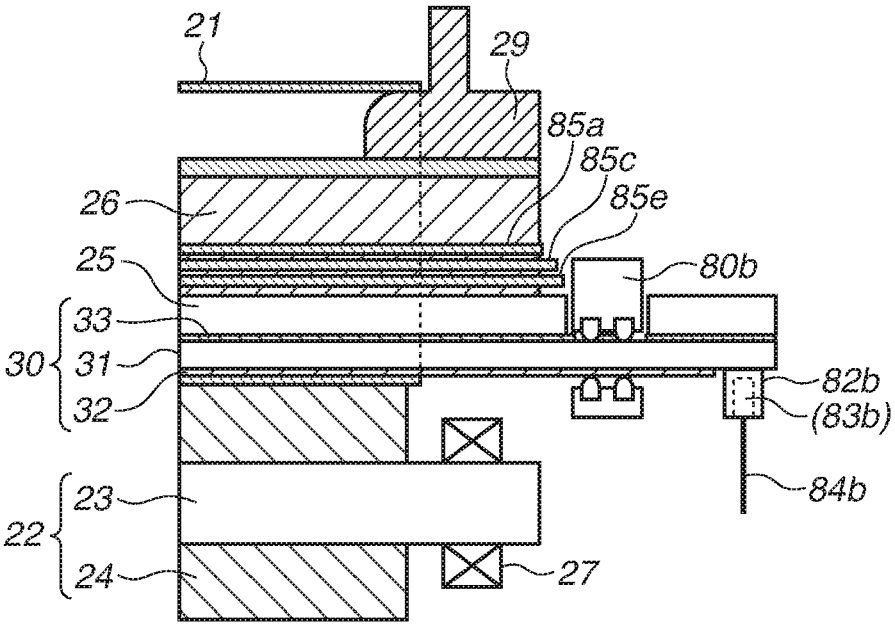
Figure 14A:
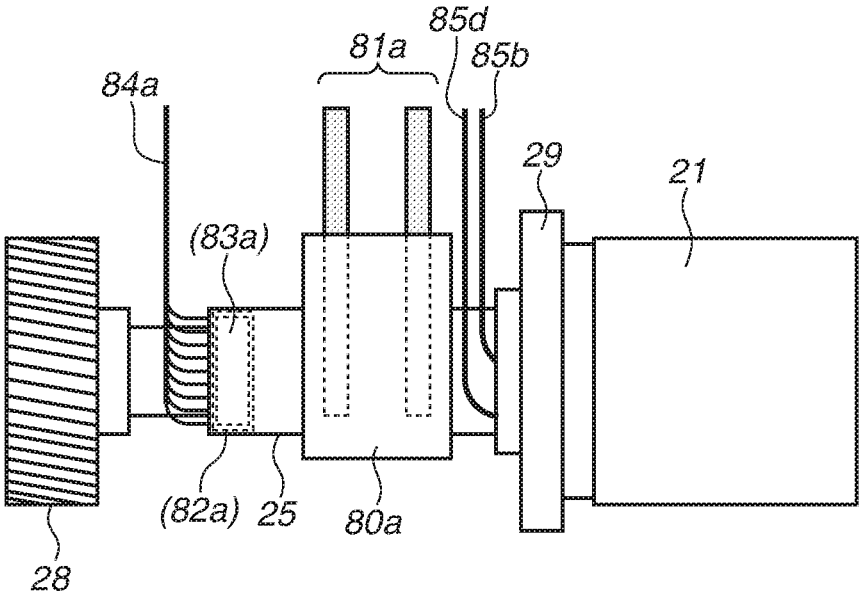
FIGS. 14A and 14B are top views illustrating the edge portion of the fixing apparatus according to the third exemplary embodiment.
Figure 14B:
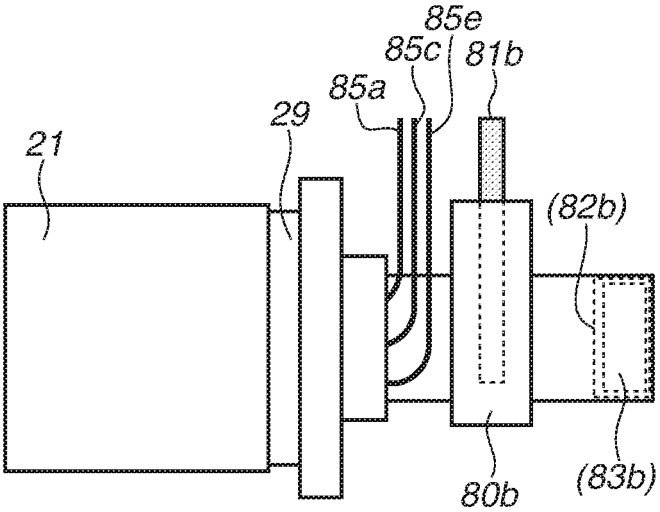

FIGS. 13A, 13B, 14A, and 14B illustrate a structure of the electric contact members and the conductive members according to the third exemplary embodiment. FIGS. 13A and 13B illustrate is a cross-sectional view viewed from the line A-A specified in FIG. 2 and illustrate a structure of each edge portion of the fixing device 20. FIG. 13A illustrates a structure of the driving-side edge portion, and FIG. 13B illustrates a structure of the non-driving-side edge portion. Further, FIGS. 14A and 14B correspond to top views of FIG. 13. FIG. 14A illustrates the structure of the driving-side edge portion, and FIG. 14B illustrates the structure of the non-driving-side edge portion.

Electric contact members 80*a* and 80*b* feed power to the electrodes 76*f*, 76*g*, 76*h*, and 76*i* for heat generation members and are connectors for heat generation members including U-shaped plug-in connectors. Cables 81*a* and 81*b* which are conductive members extend from the connectors 80*a* and 80*b* for heat generation members along a shorter-side direction of the heater 70 and are connected to the control circuit 14 through a path (not illustrated). The electrode 79*a* for thermistors which is on the non-driving side is provided with a male connector 82*b*. The male connector 82*b* is insertable and removable in a direction that is perpendicular to a surface of the heater 70. On the other hand, the electrode 79*b* for thermistors which is on the driving-side is provided with a male connector 82*a*. The male connector 82*a* is insertable and removable in the direction that is parallel to the surface of the heater 70. Cables 84*a* and 84*b* which respectively have female connectors 83*a* and 83*b* are respectively connected to the male connectors 82*a* and 82*b*. The female connectors 83*a* and 83*b* are respectively provided to an edge of the cable 84*a* and an edge of the cable 84*b*. The cables 84*a* and 84*b* of the female connectors 83*a* and 83*b* are connected to the control circuit 14.

A cable 85*a* is a conductive member connected to the electrode 76*a* for heat generation members. Similarly, cables 85*b* to 85*e* are respectively connected to the electrodes 76*b* to 76*e* for heat generation members. The cables 85*a* to 85*e* are wired along the longer-side direction LD in an inner space of the film 21. Edge portions of the cables 85*b* and 85*d* extend outward from an opening of an edge of the film 21. Edge portions of the cables 85*a*, 85*c*, and 85*e* extend outward from an opening of another edge of the film 21. Further, the cables 85*a* to 85*e* are wired through the inside of the connectors 80*a* and 80*b* for heat generation members toward the shorter-side direction of the heater 70.

The electric contact members (connectors 80*a* and 80*b* for heat generation members) for heat generation members and the conductive members (cables 81*a* and 81*b* for heat generation members) for heat generation members, which are provided inside in the longer-side direction LD of the heater 70, are provided along the shorter-side direction of the heater 70 also in the third exemplary embodiment. Specifically, the insulation distance is preserved between the electric contact members and the conductive members and the other electrodes while the electric contact members and the conductive members which are provided inside in the longer-side direction LD do not pass by the back of the electrodes provided outside, as in the first and second exemplary embodiments. Especially in the heater structure having a large number of divisions as described in the present exemplary embodiment, many connectors and cables are provided and congested. Thus, the structure according to the present exemplary embodiment is effective for realizing a compact layout while preserving the insulation distance.

The wiring direction of the conductive members extending from the electrode group provided inside in the longer-side direction LD of the heater according to the first to third exemplary embodiments only needs to be the shorter-side direction of the heater, and the conductive members can be wired in either one of upstream and downstream directions of the sheet conveyance direction of the recording material S. Further, while the thermistors described above in the first to third exemplary embodiments are printed thermistors, chip-type thermistors can be provided to the heater.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-103911, filed May 30, 2018, which is hereby incorporated by reference herein in its entirety.

What is claimed is:

1. A heater for use in a fixing apparatus configured to fix an unfixed toner image formed on a recording material to the recording material, the heater comprising:

a substrate;

a plurality of heat generation members which is formed on a first surface of the substrate and is controllable independently of each other;

a first electrode group which is formed on the first surface and with which a plurality of first power feeding terminals configured to feed power to the plurality of heat generation members and provided to the fixing apparatus is in contact;

a first protection layer covering the plurality of heat generating members so that the first electrode group is exposed;

a plurality of temperature detection elements formed on a second surface of the substrate which is on an opposite side to the first surface; and a second electrode group which is formed on the second surface and with which a plurality of second power feeding terminals configured to feed power to the plurality of temperature detection elements and provided to the fixing apparatus is in contact;

a second protection layer covering the plurality of temperature detection elements so that the second electrode group is exposed, wherein the first electrode group is the group that is exposed without being covered by the first protection layer, and the second electrode group is the group that is exposed without being covered by the second protection layer, wherein at least an electrode of the first electrode group and at least an electrode of the second electrode group are formed in a region nearer to one edge portion of the substrate than to a center of the substrate in a longitudinal direction of the substrate, and wherein as seen in a direction perpendicular to the longitudinal direction of the substrate, a nearest electrode that is nearest to the second electrode group in the longitudinal direction among the first electrode group formed in the region nearer to the one edge portion and the second electrode group are provided with a space between the nearest electrode and the second electrode group in the longitudinal direction of the substrate.

2. The heater according to claim 1, wherein the plurality of heat generation members is provided along the longitudinal direction of the substrate and is aligned in the direction perpendicular to the longitudinal direction of the substrate.

3. The heater according to claim 1, wherein the plurality of heat generation members is aligned in the longitudinal direction of the substrate.

4. The heater according to claim 1, wherein the plurality of temperature detection elements is provided at a position overlapping a region in which the plurality of heat generation members is formed in the longitudinal direction of the substrate, and the plurality of temperature detection elements is aligned along the longitudinal direction of the substrate.

5. The heater according to claim 1, wherein the second electrode group is provided nearer to the center of the substrate than the first electrode group in the longitudinal direction.

6. The heater according to claim 5, wherein the second electrode group is provided such that the plurality of second power feeding terminals is connected to the second electrode group from a direction which intersects with the longitudinal direction of the substrate.

7. The heater according to claim 6, wherein the second electrode group is provided such that the plurality of second power feeding terminals is connected to the second electrode group from the direction thrill which intersects with the longitudinal direction of the substrate and which is parallel to the second surface of the substrate.

8. The heater according to claim 6, wherein the first electrode group is provided such that the plurality of first power feeding terminals is connected to the first electrode group from a direction which intersects with the longitudinal direction of the substrate.

9. The heater according to claim 1, wherein the first electrode group is provided nearer to the center of the substrate than the second electrode group in the longitudinal direction.

10. The heater according to claim 9, wherein the first electrode group is provided such that the plurality of first power feeding terminals is connected to the first electrode group from a direction which intersects with the longitudinal direction of the substrate.

11. The heater according to claim 10, wherein the first electrode group is provided such that the plurality of first power feeding terminals is connected to the first electrode group from the direction which intersects with the longitudinal direction of the substrate and which is parallel to the first surface of the substrate.

12. The heater according to claim 11, wherein the second electrode group is provided such that the plurality of second power feeding terminals is connected to the second electrode group from a direction which intersects with the longitudinal direction of the substrate.

13. The heater according to claim 11, wherein the second electrode group is provided such that the plurality of second power feeding terminals is connected to the second electrode group from a direction which is parallel to the longitudinal direction of the substrate.

14. The heater according to claim 3, wherein the plurality of temperature detection elements is provided at a position overlapping a region in which the plurality of heat generation members is formed in the longitudinal direction of the substrate, and the plurality of temperature detection elements is aligned along the longitudinal direction of the substrate.

15. The heater according to claim 14, wherein the first electrode group is provided nearer to the center of the substrate than the second electrode group in the longitudinal direction.

16. The heater according to claim 15, wherein the first electrode group is aligned in the longitudinal direction of the substrate, and the second electrode group is aligned in the direction perpendicular to the longitudinal direction of the substrate.

17. A fixing apparatus comprising:

a cylindrical film which is in contact with an unfixed toner image formed on a recording material; and a heater which is in contact with an inner surface of the film, wherein the unfixed toner image is fixed to the recording material with heat of the heater, and wherein the heater is the heater according to claim 1.

18. The fixing apparatus according to claim 17, wherein the heater is provided in such a manner that a surface of the heater on which the plurality of heat generation members is formed is in contact with the inner surface of the film.

19. The fixing apparatus according to claim 17, wherein the heater is provided in such a manner that a surface of the heater on which the plurality of temperature detection elements is formed is in contact with the inner surface of the film.

* * * * *